United States Patent [19]

Lane, Jr. et al.

[11] Patent Number: 4,795,271

[45] Date of Patent: Jan. 3, 1989

[54] FREE STANDING PRODUCT POUCH

[75] Inventors: William A. Lane, Jr., Lake Arrowhead; Steven D. Davis, Yuciapa, both of Calif.

[73] Assignee: W. A. Lane, Inc., San Bernardino, Calif.

[21] Appl. No.: 131,446

[22] Filed: Dec. 11, 1987

[51] Int. Cl.[4] ..... B65D 30/16

[52] U.S. Cl. ..... 383/104; 383/906; 206/632; 53/412; 53/452; 426/115; 426/410; 426/413

[58] Field of Search ..... 383/104, 906; 229/103.1; 206/632, 629, 634; 53/412, 413, 452, 469, 479; 426/410; 426/413, 106, 115

[56] References Cited

U.S. PATENT DOCUMENTS

| | | | |
|---|---|---|---|
| 1,657,639 | 1/1928 | Payne | 383/88 X |
| 2,015,972 | 10/1935 | Sodergren | 53/412 X |
| 2,718,105 | 9/1955 | Ferguson et al. | 383/104 X |
| 2,775,082 | 12/1956 | Vogt | 53/469 |
| 2,849,321 | 8/1958 | Lhermitte et al. | 229/103.1 X |
| 3,074,612 | 1/1963 | Schneider | 383/906 X |
| 3,380,646 | 4/1968 | Doyen et al. . | |
| 3,462,070 | 8/1969 | Corella | 206/632 X |
| 3,502,521 | 3/1970 | Doyen et al. . | |
| 3,799,914 | 3/1974 | Schmit et al. | 426/410 X |
| 4,361,235 | 11/1982 | Gautier | 383/104 X |
| 4,428,477 | 1/1984 | Cristofolo | 206/210 |

*Primary Examiner*—Jimmy G. Foster
*Assistant Examiner*—Nova Stucker
*Attorney, Agent, or Firm*—Herb Boswell

[57] ABSTRACT

A free standing product pouch for containing a product as, for instance, a fluid product includes a pouch formed with an elongated edge having ends. The pouch is folded about a point on the edge to locate the ends of the edges together in proximity with one another. The ends of this edge are connected together to maintain the pouch in a folded configuration. The folded configuration of the pouch is free standing on a surface.

20 Claims, 2 Drawing Sheets

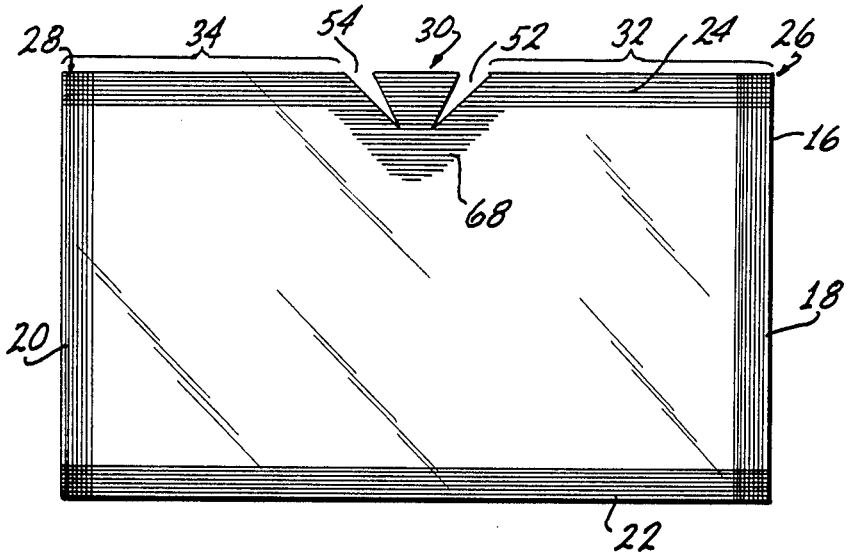
Fig. 6
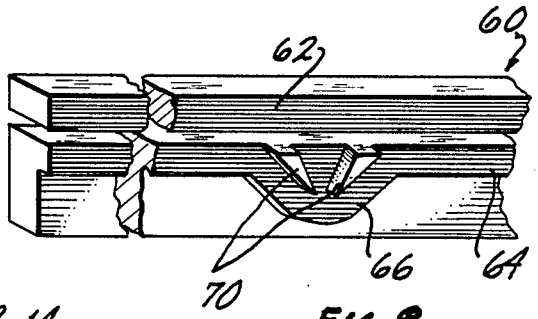
Fig. 8
Fig. 7
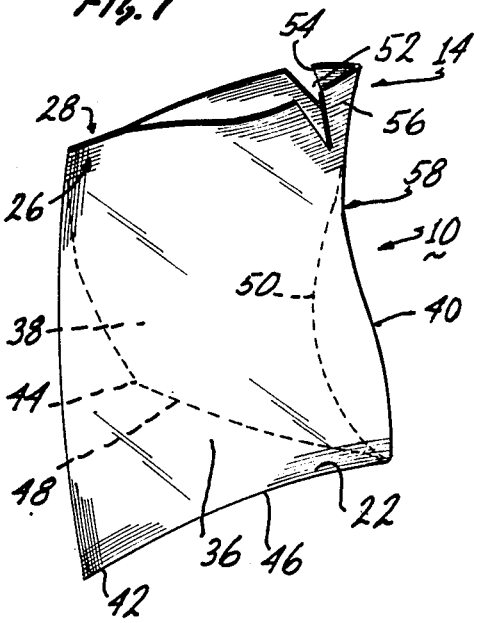

FREE STANDING PRODUCT POUCH

BACKGROUND OF INVENTION

This invention is directed to a free standing container and processes for forming the free standing container. The free standing container includes a pouch containing a quantity of a product. The pouch is folded along an elongated edge to bring the ends of that edge together and these ends are then connected together to maintain the pouch in the free standing folded configuration.

The packaging of solid food stuff in many instances is much simpler than packaging required for fluids. Since the solid food stuff defines its own shape, it is inherently "free standing". The food stuff itself can be utilized to determine the package shape and to support the package. This gives packagers of such solid food products a wide latitude in choosing packaging material for thier products.

Fluids, on the other hand, must be supported in containers of predefined shapes. For many years containers for fluid were exclusively limited to either cans or bottles. With both cans and bottles, however, the empty container is of the same size as the filled container. This presents disposal problems in many environments.

Recently heat sealable films have become available and new packaging techniques utilizing these films have been developed. Many products are now packaged in heat sealable film "pouches." In certain industries as, for instance, the fast food industry these pouches have become a dominant packaging method. These pouches are extremely utilitarian for certain semi-fluid products such as catsup, salad dressing, soups and the like.

The above referred to pouches once they are empty of their contents are capable of being crumpled, rolled, folded or the like to small volumes facilitating disposal of the empty pouch. Further, these pouches are capable of being produced in large quantities in high production rates on continuous form, fill and seal pouch packaging machines. Such machines are commercially available as for instance, from the W. A. Lane, Inc. company, San Bernardino, Calif.

Typically a pouch produced on a form, fill and seal pouching machine has a front film and a back film which are heat sealed together around their edges on three sides. The partially formed pouch is then filled with a product and heat sealed on the fourth side to complete the pouch.

The above referred to pouches, while being very utilitarian for products such as condiments, salad dressing, oils and the like are limited in their utility with respect to serving as a container for a beverage which is consumed incrementally over time. This is because these pouches are not free standing.

In many situations it is advantageous to have a beverage container which is both free standing and is easily disposed of. Thus, while bottles and cans are free standing they present environmental disposable problems and while pouches are easily disposed of, they are not free standing.

One solution is to support the pouches in a further container as, for instance, in a cardboard box or the like. Thus, certain products are commercially available which utilize a cardboard or heavy paper container as a support container for a pouch located therein. While this is certainly utilitarian, it increases the consumer cost of the product in that two containers are utilized, i.e. the support container—the box and the fluid container—the pouch liner.

A further type of free standing "film" container is known which does not require an external support. This type of container, however, utilizes three discrete films. These are a front film, a back film, and a bottom film. This type of container is described in U.S. Pat. Nos. 3,380,646 and 3,502,521.

While the containers of U.S. Pat. Nos. 3,380,646 and 3,502,521 meet the criteria of being both free standing and disposable, because they require heat sealing together three individual films or the use of preformed tubes of sealing film, at certain points in the pouches complex seals must be formed. Thus, at the corners where the bottom film joins both the front film and the back film a fluid tight seal has to be formed between all of the layers of film.

Because of the complexity of sealing multiple layers into a fluid tight seal generally stand alone pouches which incorporate an independent bottom layer are inherently more complicated and therefore more expensive than simple pouches having only front and back film layers.

In view of the above it is evident that there exists a need for new and improved free standing pouches capable of holding fluid contents therein.

BRIEF DESCRIPTION OF THE INVENTION

This invention provides for a free standing pouch capable of containing a quantity of a product particularly a quantity of a fluid product.

This is advantageously achieved in a free standing container which includes a pouch containing a quantity of a product. The pouch includes an elongated edge having ends. The pouch is folded about a point on the edge to locate the ends of the edge together in proximity with one another and then the ends of the edge are jointed together to maintain the pouch folded about the point.

Further, advantageously a free standing container is formed as an essentially quadrilaterally shaped pouch containing a quantity of a product. The pouch includes a top edge. The top edge has a first top edge corner and second top edge corner with these first and second top edge corners located at opposite ends of the top edge. The pouch is folded about an essentially center point in the top edge to bring a first portion of the top edge located between the center point and the first corner and a second portion of the top edge located between the center point and a second corner essentially parallel to one another and to locate the two top edge corners of the pouch together in proximity with one another. The first and second corner edges are then connected together to maintain the pouch folded about the center point.

Advantageously the pouch can be shaped as a rectangle having two long edges and two short edges. The top edge would comprise one of the long edges. A bottom edge would comprise the other of the long edges. The pouch can be folded about a center line which lies essentially perpendicular to both the top edge and the bottom edge to divide the bottom edge into two portions which are positionable with respect to one another at an acute angle to form a wedge shaped base for supporting the pouch as a free standing pouch.

Additionally, the free standing pouch can be considered as having a periphery and being folded about a point on the periphery to form a common corner on the periphery at that point. This divides the pouch into first and second regions. Each of the first and second regions includes a further corner located on the periphery. The further corners are joined together to maintain the pouch in a folded orientation. Each of the first and second regions would further include an additional periphery zone which is spaced away from both of the common corner and the further corners of the pouch with portions of this additional periphery zone separated in space from one another so as to form a support base for the free standing pouch.

The above free standing pouches thus described can be considered to have bottom edges which are located at an acute angle to one another so as to form a wedge shaped base which supports the free standing pouch. Alternatively, this wedge shape can be considered as forming two sides of an imaginary triangle having an open third side with bottom corners of the pouch considered to be at the apices of this imaginary triangle.

The free standing containers of the invention can be advantageously formed in a process which includes the steps of forming a pouch, filling a pouch with a product, folding the pouch about a point on an edge of the pouch so as to bring the ends of the edge together in proximity with one another and connecting these ends of this edge together to maintain the pouch in a folded orientation. In this process the ends of the edge of the pouch can advantageously be joined by heat sealing these ends together or alternatively by joining them together with a suitable adhesive. In so forming the pouch the pouch can be folded over a mandrel and the ends of the edge heat sealed or adhesively jointed together and the mandrel removed yielding the free standing pouch.

BRIEF DESCRIPTION OF THE INVENTION

This invention will be better understood when taken in conjunction with the drawings wherein:

FIG. 6 is a front elevational view of a pouch which has been formed, filled and sealed but has not yet been folded into a free standing pouch of the invention;

FIG. 7 is an isometric view of a completed free standing pouch formed utilizing the pouch of FIG. 6; and FIG. 8 is an isometric view of a portion of a head seal utilized to seal the pouch of FIG. 6 and to form notches therein.

This invention utilizes certain principles and/or concepts as are set forth in claims appended hereto. Those skilled in the packaging arts to which this invention pertains will realize that these principles and/or concepts are capable of being illustrated in a variety of embodiments. For this reason this invention should not be construed as being limited solely to the illustrated embodiments, but should only be construed in view of the claims.

DETAILED DESCRIPTION OF THE INVENTION

Figure 1:
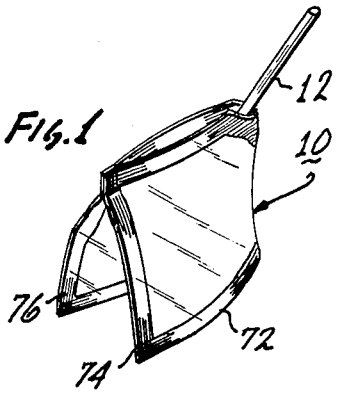
FIG. 1 is an isometric view of a free standing pouch of the invention showing the use of this pouch by insertion of a straw into the pouch.

In FIG. 1 a free standing pouch 10 of the invention is shown in use in conjunction with a straw 12 for extracting the contents from the free standing pouch 10. Typically the free standing pouch 10 would be utilized to hold liquids and beverages as, for instances, juices, non-carbonated soft drinks and the like. Because of the shape of the free standing pouch 10 it can conveniently be packed in a lunch box or a lunch sack or utilized in environmentally sensitive settings such as by back packers, hikers and others who must carry out from the environmental setting everything they bring in with them. The free standing pouch 10 can be formed of any size, however, typically it would be formed of a size suitable for holding a few ounces of a beverage or fluid as, for instance, from 2 to 16 ounces.

Alternatively to serving as simply a pouch for beverages, the free standing pouch 10 can also be utilized for holding other products as, for instance, lemon juice, salad dressings, catsup or mustard in a quantity large enough to be displayed on a restaurant table and utilized by multiple patrons of the restaurant. Thus, instead of having to deposit a handful of individual catsup pouches, one large free standing pouch 10 could be utilized to serve all occupants of a table at a restaurant.

For use in containing beverages, the free standing pouch 10 can be utilized in conjunction with a straw or the beverage can be directly sipped from a corner of the pouch. As is seen in FIG. 1, a corner 14 of the pouch, hereinafter identified in greater detail as a common corner 14, can be snipped off, punctured or torn to allow insertion of the straw 12 into the pouch 10. As hereinafter described, the pouch 10 can include tear zones in the corner 14 to facilitate removal of material at the corner 14 to form an opening into the interior of the pouch 10.

Alternatively, however, the pouch 10 can be formed without these tear zones and the contents of the pouch 10 retrieved from the pouch 10 by puncturing the pouch 10 with a pointed straw or by snipping the common corner 14 with scissors, a knife or the like.

Figure 2:
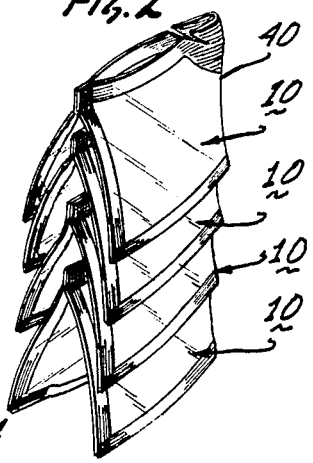
FIG. 2 is an isometric view showing an advantageous method of shipping and storing a multitude of the pouches of the invention.

The shape of the pouch 10 contributes to facilitated stacking, packaging and storing of a number of the pouches 10 together. Thus, as is seen in FIG. 2, four of the individual pouches 10 have been stacked one upon the other. As so stacked they then can be conveniently packaged in an outer wrap to be sold as a unit to the consumer. Further, details with respect to FIGS. 1 and 2 will be more apparent after considering the formation and construction of an individual pouch 10 as per the additional figures.

Referring now to FIG. 6, a flat pouch 16 is shown. The pouch 16 can be conveniently formed on a form, fill and seal packaging machine as, for instance, machinery sold by W. A. Lane, Inc., San Bernardino, Calif. In forming pouches such as pouch 16, a front and back film are heat sealed together along side edges 18 and 20 utilizing side seals which heat seal the front and back films together. The films are then sealed together along the bottom edge 22 utilizing a head seal. The pouch is then filled with product and a top edge 24 formed to seal the contents of the product within the pouch. The top edge 24 is also formed utilizing the head seal.

Typically the head seal forms the top edge on a lower filled pouch concurrently with forming the bottom edge on an upper empty pouch as the front and back films progress through a form, fill and seal packaging machine. In any event, the pouch 16 is formed in a flat configuration on a form, fill and seal packaging machine.

For forming a free standing pouch 10 of the invention, advantageously the pouch 16 is formed as an elongated retangular pouch having bottom and top edges 24 and 22 which are longer than the side edges 18 and 20. Other geometries could be utilized, however, for convenience of forming the pouch 16 on commercially available form, fill and seal pouching machines, the quadrilateral rectangular shape of pouch 16 is preferred.

The top edge 24 of the pouch 16 is an elongated edge having respective right and left side ends which define corners 26 and 28 respectively. Thus, corner 26 is formed where edge 18 meets with edge 24 and corner 28 is formed where edge 20 meets with edge 24. In forming the free standing pouch 10 of the invention the pouch 16 is folded about a point generally indicated by the numeral 30 in FIG. 6 which is centered on the edge 24. The pouch 16 is folded about this point 30 to bring a first portion 32 of the top edge 24 located between point 30 and corner 26 over and parallel to a second portion 34 of top edge 24 between point 30 and corner 28. Thus, when the pouch 16 is folded about the point 30, the portion 32 overlies the portion 34.

The corner 26 is then joined to the corner 28 to form the pouch 10 seen in FIG. 7. The point 30 has now been incorporated into common corner 14 formed in the top edge 24 upon folding of this top edge back upon itself. Further, the pouch 10 is now divided into first and second regions, region 36 seen in the foreground in FIG. 7 and region 38 hidden and shown by phantom line in FIG. 7.

The two regions 36 and 38 are joined along center line 40 which has been formed in folding the pouch 16 into the pouch 10. However, these regions can be spread apart about "hinges" formed by the center line 40 and the joined corners 26 and 28 such that lower corners 42 and 44 in the respective regions 36 and 38 are positioned distal from one another shaping the bottom edge 22 in a wedge shape. This wedge shape has a first section 46 which is located at an acute angle to a second section 48. The sections 46 and 48 can also be thought of as two sides of a triangle, i.e. an isosceles triangle, which has a third open side, i.e. the side directly between corners 42 and 44.

It is the wedge or triangular shape on the base of the pouch 10 which results in the pouch 10 being free standing.

Considered in another way, the pouch 10 as shown in FIG. 7 has a periphery which extends completely around the edges 18, 20, 22 and 24 of the pouch 16 of FIG. 6. The pouch is folded at a point, i.e. point 30, on this periphery to form a common corner, i.e. corner 14, and to divide the pouch into first and second regions, regions 36 and 38. Each of these regions include a further corner, i.e. corner 26 of region 36 and corner 28 of regions 38. These further corners are joined together.

Each of the regions 36 and 38 include a further additional peripheral zone, the section 46 and corner 42 thereon for region 36 and the section 48 and corner 48 thereon for region 38. Both of these additional peripheral zones are spaced from both the common corner, corner 14 and the further corners, corners 26 and 28. Further, these further peripheral zones can be spaced apart from one another in space, i.e. the corners 42 and 44 can be pulled apart one from the other to form the wedge or triangular shaped base of the free standing pouch 10. The corners 42 and 44 can be considered as additional corners located in these peripheral zones.

Also seen in FIG. 7 is the portion of the back film located along the center line 40. This is shown in phantom line along back center line 50. As can be seen the back and front films bulge out about the lines 40 and 50 to form a fluid conduit between the first and second sections, 46 and 48. That is the entire interior of the pouch as it existed as pouch 16 is still a single reservoir as it exists in the free standing pouch 10. There is only a single interior reservoir or chamber even though the free standing pouch 10 can be considered as containing the first and second sections 46 and 48. Thus the pouch 10 can be emptied from a single opening irrespective of where that opening is located in the pouch 10.

The pouch 10 can be formed to include the above referred to tear notches, shown as notches 52 and 54 in both FIGS. 6 and 7. When the pouch 16 is folded about the point 30 to form the free standing pouch 10, the tear notches 52 and 54 align with one another in the free standing pouch 10.

A tab of material 56 located at the common corner 14 can be separated from the remainder of the pouch 10 by pulling this tab of material 56 to extend the tear notches 52 and 54 through the common corner 14 tearing through the material located along center lines 40 and 50 such that it opens the pouch 10 at a point 58.

Because the tear notches 52 and 54 are oriented at an angle, when they are extended by tearing the pouch film material, the tear extends essentially along the direction of the tear notches 52 and 54 and simply removes the common corner 14 of the pouch 10 allowing access to the product located within the interior of the pouch 10.

The tear notches 52 and 54 can be formed in the unfolded pouch 16 utilizing a variety of methods. These would include concurrently forming the tear notches 52 and 54 when the seam along the top edge 24 is formed (as will be discussed below), forming them at the same time the pouch 16 is severed from a descending stream of pouches on a form, fill and seal pouching machine, or forming them as an independent operation prior to or after folding of the pouch 16 to form the free standing pouch 10.

One method of the above methods of forming the tear notches 52 and 54 is to form them concurrently with forming the seal along the top edge 24. This can be done by incorporating a die cutter into a head seal which is utilized to form the seal along the top edge 24. Such a head seal with a male die therein is shown in FIG. 8.

In FIG. 8 a head seal 60 is shown. The head seal 60 would be utilized with a mating head seal (not seperately shown or numbered) to concurrently form a top and bottom seam on a descending stream of pouches being formed on a form, fill and seal pouching machine. Thus, the head seal 60 in conjunction with its mating head seal would form the top seam on a lower most filled pouch and the bottom seam on an upper empty pouch. This is as is standard in form, fill and seal packaging machines.

The head seal 60 includes a first face 62 which would be utilized to form the bottom seam of the upper of two adjacent pouches and a second face 64 which would be utilized to form the top seam of the lower of two adjacent pouches being formed, filled and sealed on a form, fill and seal pouching machine.

The second face 64 is shaped with an area 66 which is utilized to form an indention 68 on the unfolded pouch 16 which ultimately will form the material tab 56 on the folded pouch 10. Located in the area 66 are two male dies collectively identified by the numeral 70. These would be utilized in conjunction with two female die openings in the opposing head seal (not separately numbered or illustrated) such that the tear notches 52 and 54 are formed concurrently when the two head seals are brought together by location of the male dies 70 into the opposing female openings (not separately illustrated or numbered) in the opposing head seal (not separately illustrated or numbered).

To facilitate folding of the unfolded pouch 16 into the folded free standing pouch 10, normally the unfolded pouch 16 would be underfilled, that is it would not be filled with as much product as would be used if the pouch 16 was not to be folded. This underfilling facilitates folding of the pouch 16 into the configuration of the free standing pouch 10. While a normal unfolded pouch may be designed to hold 8 ounces of liquid, if this pouch is to be formed into a free standing pouch 10 by folding of the same, it might be slightly underfilled with for example only 7 ounces of liquid.

Depending upon the product to be utilized in the free standing pouch and whether it is a small pouch to hold as, for instance, 2 ounces of lemon juice, or a large pouch to hold 12 ounces of beverage, the overall dimensions of the unfolded pouch 16 would be chosen such that when the pouch is folded into the free standing pouch 10 it would conveniently hold the desired final volume of the liquid. Thus if it was desired to have an 8 ounce free standing beverage container, the unfolded pouch would be choosen to "theoretically" be capable of holding greater than 8 ounces but would be underfilled to only the desired 8 ounces size.

Referring back to FIG. 1, in FIG. 1 the pouch 10 illustrated therein is being viewed with respect to the pouch 10 of FIG. 7 from the open left hand side of the pouch in FIG. 7. Thus in FIG. 1 the wedge shape or partial triangular shape of the base 72 is evident. This provides a convenient base or pedestal for supporting the pouch 10 on a surface as a free standing pouch.

The wedge or open triangular shape of the base 72 also facilitates stacking of the pouches as is evident in FIG. 2. In each of the pouches of FIG. 2 the center lines 40 are aligned essentially parallel to one another on the right hand side of FIG. 2. Since the back side (as viewed in FIG. 2) of the pouches are open, this allows for stacking of one pouch on the other by simply overlaying the pouches such that a bottom most pouch fits into the internal pocket formed in an uppermost pouch. While for the purposes of illustration in FIG. 2 the pouches are shown stacked vertically, they also could be stacked horizontally as is evident by simply rotating the stack of pouches seen in FIG. 2, 90° counterclockwise.

It is also evident from FIGS. 1 and 2 that actually two wedge shaped or opened sided triangular shapes are formed on each of the pouches 10. In addition to the base 72, the edges 74 and 76 of the folded pouch 10 which correspond to the side edges 18 and 20 of the unfolded pouch 16, respectively, also form a wedge or open sided triangular shape and could serve as a support or base for a free standing pouch. Note, if the pouch 10 of FIG. 1 was rotated 90° counterclockwise, the common corner 14 would still be oriented in an elevated position and the contents of the pouch 10 would still be dispensed in the exact same manner as for the orientation of the pouch 10 as seen in FIG. 1.

Figure 3:
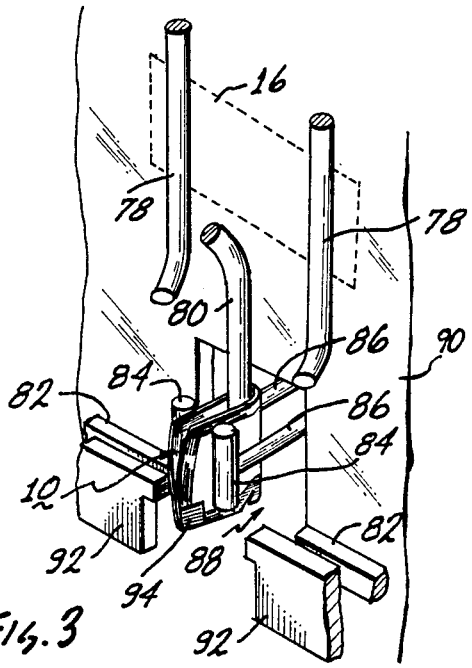
FIG. 3 is an isometric view of a pouch as it is being formed including a first embodiment of an apparatus used for forming a free standing pouch of the invention.
Figure 4:
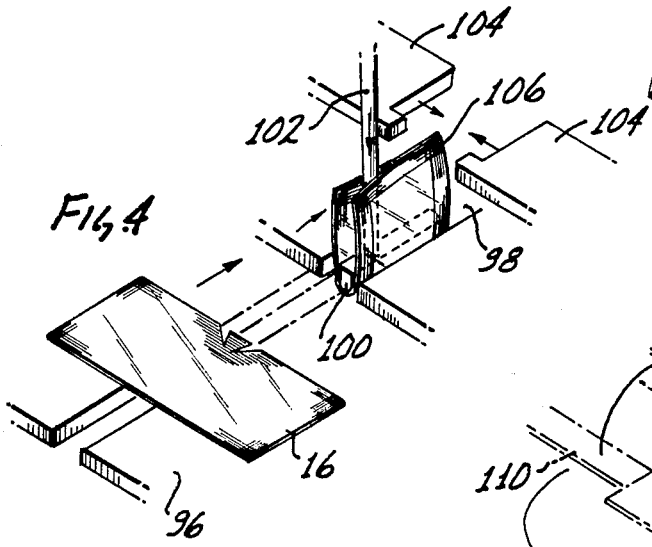
FIG. 4 is an isometric view similar to FIG. 3 showing a second embodiment of an apparatus utilized for forming a free standing pouch of the invention.
Figure 5:
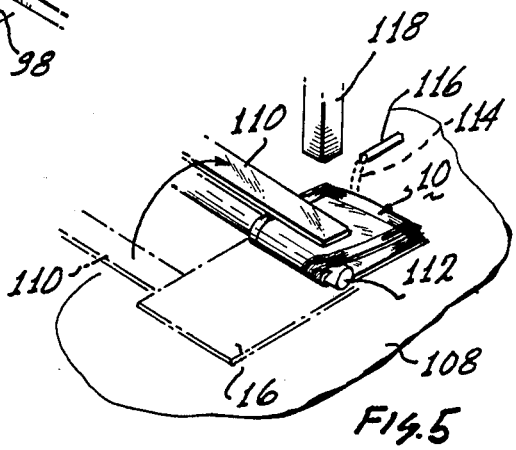
FIG. 5 is an isometric view similar to FIGS. 3 and 4 showing a further embodiment of apparatus utilized for forming a free standing pouch of the invention.

FIGS. 3, 4 and 5 illustrate methods of folding a filled unfolded pouch as per pouch 16 of FIG. 6 into the free standing pouch 10. In reference to FIG. 3, a pouch 16 having been formed, filled and sealed descends off of the cutting mechanism of a form, fill and seal pouching machine behind guide bars, collectively identified by the numeral 78. As the pouch 16 descends behind the guide bars 78 it moves behind a central mandrel 80.

The mandrel 80 guides the descending pouch 16 downward until it abuts against stop bars collectively identified by the numeral 82. At this time the unfolded pouch 16 is supported against the top of the stop bars 82 and held in place behind the mandrel 80. Fold rollers collectively identified by the numeral 84 come forward on the ends of rods collectively identified by the numeral 86 from a recessed position behind cutout 88 in guide plate 90. The fold rollers 84 contact the flat unfolded pouch 16 and wrap it around the mandrel 80. This lifts the pouch 16 off of the stop bars 82, however, because of the fluid within the interior of the pouch 16, it is held by friction resulting from folding and squeezing of the pouch over the mandrel 80 by the fold rollers 84.

Next corner seals collectively identified by the numeral 92 come together contacting the corner 94 to seal the left and right sides of the pouch together to hold it in a folded orientation. The fold rollers 84 are now retracted back into the cutout 88. Since the fluid pressure between the fold rollers 84, the pouch 16 and the mandrel 80 has been released by withdrawal of the fold rollers 84, the folded pouch 10 now drops off of the lower end of the mandrel 80 into a waiting collection bin or the like.

In a further method of folding the unfolded pouch 16 into the free standing folded pouch 10, as shown in FIG. 4 the pouch 16 can be moved across a horizontal table 96 as, for instances using moving fingers (not separately shown or numbered). The pouch 16 is moved into a position over a notch cutout 98 in the table 96. A mandrel 100 on the end of an arm 102 descends against the unfolded pouch 16 forcing it down into the notch cutout 98. This folds the pouch 16 about the mandrel 100.

As the folded pouch is pushed into the notch cutout 98 corner seals collectively identified by the numeral 104 come together against corner 106 to seal this corner holding the pouch in a folded configuration. Mandrel 100 then further descends into the notch 98 until the pouch is completely pushed down through the notch 98. The mandrel 100 is then retracted upwardly freeing itself from the pouch 98 which is allowed to drop into an appropriate bin or other collection device below the table 96.

In FIG. 5 a further method of folding and holding a pouch in a folded orientation is illustrated. In FIG. 5, as is seen in phantom line, the unfolded pouch 16 is positioned on a table 108. It is positioned over an arm 110 and underneath a central mandrel 112. The arm 110 then moves in an arcuate manner upwardly and to the right to fold the pouch over the mandrel 112 as is seen in solid line in FIG. 5. However, prior to folding of the pouch on itself, a drop of adhesive 114 is dispensed from dispenser spout 116 onto the corner of the pouch 16.

A pressure jaw 118 then descends downwardly toward the table 108 squeezing the corners of the folded pouch together to adhere these corners with the adhesive 114 which has been positioned between the two sides of the folded pouch. Once the joint is formed the pressure jaw 118 retracts upwardly, the arm 110 is arcuately moved counterclockwise, the mandrel 112 is retracted and the folded pouch 10 is then moved off of the table 108 utilizing appropriate movement fingers or the like (not separately shown or identified).

While for the purposes of illustration the folding procedure of FIG. 3 has been shown with the unfolded pouch 16 moving vertically and the folding procedures of FIGS. 4 and 5 have been shown with the unfolded pouch 16 moving horizontally, it is evident that the apparatus utilized for FIG. 3 would also work for movement of the pouch 16 horizontally except instead of gravity assist, appropriate mechanical fingers or a moving belt or the like would be needed for movement of the pouch 16. Further, gravity assist could be utilized to move the pouch 16 in the processes of FIGS. 4 and 5 instead of utilizing mechanical fingers or the like to accomplish this movement.

What is evident in each of the processes of FIGS. 3, 4 and 5 is that a pouch having a quantity of product in the pouch is first folded to bring the ends of an edge together and these ends are then contacted together and maintained together utilizing a heat sealing method or an appropriate adhesive joint the like.

What is claimed is:

1. A container which comprises:

an essentially quadrilateral shaped pouch containing a quantity of a product;

said pouch including a top edge, said top edge including a first top edge corner and a second top edge corner, said first and second top edge corners located at opposite ends of said top edge;

said pouch folded about an essentially center point in said top edge to bring a first portion of said top edge located between said center point and said first corner and a second portion of said top edge located between said center point and said second corner essentially parallel to one another and to locate said two top edge corners of said pouch together in proximity with one another;

means directly connecting said first and second corners together to maintain said pouch folded about said center point.

2. A free standing container of claim 1 wherein:

said quadrilateral shaped pouch is a parallelogram having two parallel sets of edges; and said corners lay on opposite ends of one of said edges of one of said sets.

3. A free standing container which comprises:

an essentially quadrilateral shaped pouch containing a quantity of a product;

said pouch including a top edge, said top edge including a first top edge corner and a second top edge corner, said first and second top edge corners located at opposite ends of said top edge;

said pouch folded about an essentially center point in said top edge to bring a first portion of said top edge located between said center point and said first corner and a second portion of said top edge located between said center point and said second corner essentially parallel to one another and to locate said two top edge corners of said pouch together in proximity with one another;

means directly connecting said first and second corners together to maintain said pouch folded about said center point;

said pouch including a bottom edge, said bottom edge located essentially parallel to said top edge;

said center point laying essentially on a line which passes through both said top edge and said bottom edge; and said line dividing said bottom edge into two portions, said two portions of said bottom edge positionable at an acute angle with respect to one another forming a wedge shaped base.

4. A free standing container of claim 3 wherein:

said quadrilateral shaped pouch is rectangular in shape having two long and two short edges;

said top edge comprises one of said long edges; and said bottom edge comprising the other of said long edges.

5. A free standing container of claim 3 wherein:

said line is a center line and passes essentially perpendicular to both said top edge and said bottom edge; and said center line divides said bottom edge such that said portions of said bottom edge are essentially equal whereby said wedge shaped base forms two essentially equal sides of an isosceles triangular base, the third side of which is open.

6. A free standing container of claim 3 wherein:

said means for connecting said first and said second corners together comprises a heat seal formed between said first and said second corners.

7. A free standing container of claim 3 wherein:

said means for connecting said first and said second corners together comprises an adhesive joint formed between said first and said second corners.

8. A free standing container of claim 4 wherein:

said means for connecting said first and said second corners together comprises a heat seal formed between said first and said second corners.

9. A free standing container of claim 4 wherein:

said bottom edge is located essentially parallel to said top edge;

said center point laying essentially on a center line which is located essentially perpendicular to both said top edge and said bottom edge; and said center line dividing said bottom edge into two essentially equal portions, said two portions of said bottom edge positionable at said acute angle with respect to one another to form said wedge shaped base.

10. A container which comprises:

a flat pouch having two parallel edges;

said pouch containing a quantity of product;

one of said edges being an elongated top edge having ends;

said pouch folded about a point on said top edge to locate said ends of said top edge together in proximity with one another;

means directly connecting said ends of said top edge together to maintain said pouch folded about said point; and the other of said edges comprising a bottom edge, said bottom edge folded about a point dividing said bottom edge into two portions, said portions of said bottom edge positionable at an acute angle with respect to one another forming a wedge shaped base.

11. A container of claim 10 wherein:

said point on said top edge comprises a center point dividing said top edge into two essentially equal portions.

12. A container of claim 11 wherein:

said pouch is essentially rectangular in shape having two long sides and two short sides; and said top edge comprising one of said two long sides.

13. A container of claim 10 wherein:

said means for connecting said ends of said top edge together comprises a heat seal formed between said ends.

14. A free standing container which comprises:

a pouch containing a quantity of product;

said pouch having a periphery;

said pouch folded about a point on said periphery to form a common corner on said periphery at said point and to divide said pouch into a first region and a second region;

each of said first and second regions including a further corner located on said periphery distal from said pouch fold;

said further corners jointed together;

each of said first and second regions further including an additional peripheral zone, said additional peripheral zones spaced apart along said periphery of said pouch from both said common corner and said further corners of said pouch with portions of said additional peripheral zones separated in space from one another so as to form a support base for said container.

15. A free standing container of claim 14 wherein:

each of said additional peripheral zones includes an additional corner, said additional corners spaced apart from said further corners along edges located on said pouch periphery and spaced apart from each other along a further edge located on said pouch periphery and positionable in free space in positions separated from one another.

16. A process of forming a free standing container which comprises the steps of:

forming a pouch having a periphery;

filling said pouch with a product;

folding said pouch about a point on said periphery to form a common corner on said periphery at said point and to divide said pouch into a first region and a second region and wherein each of said first and said second regions include a further corner located on said periphery distal from said pouch fold and an additional peripheral zone, said additional peripheral zones spaced apart along said periphery of said pouch from both said common corner and said further corners of said pouch with portions of said additional peripheral zones separable in space from one another to form a support base for said container; and connecting said further corners directly together to maintain said pouch in said folded orientation.

17. The process of claim 16 including:

choosing said pouch as a rectangular shaped pouch having two long sides and two short sides; and folding said pouch about a point located on one of said long sides of said rectangular pouch.

18. The process of claim 16 including:

connecting said ends of said edge together by heat sealing said ends to one another.

19. The process of claim 16 including:

folding said pouch about a mandrel;

heating sealing said ends of said edge together; and removing said mandrel.

20. The process of claim 16 including:

folding said pouch about a mandrel;

joining said ends of said edge together with an adhesive; and removing said mandrel.

* * * * *